United States Patent [19]

Volpato

[11] Patent Number: 4,700,958

[45] Date of Patent: Oct. 20, 1987

[54] DEVICE APT TO PERMIT SKIING ON SNOWLESS GROUND

[76] Inventor: Alberto Volpato, Via Marenco, 3, Milano, Italy

[21] Appl. No.: 863,516

[22] Filed: May 15, 1986

[30] Foreign Application Priority Data

May 15, 1985 [IT] Italy ..... 21821/85[U]

[51] Int. Cl.[4] ..... A63C 5/035

[52] U.S. Cl. ..... 280/11.1 BT

[58] Field of Search ..... 280/8, 11.1 R, 11.1 BR, 280/11.1 BT, 11 ET, 11.115

[56] References Cited

U.S. PATENT DOCUMENTS 4,134,600 1/1979 McDonald et al. ..... 280/1.1 BT

FOREIGN PATENT DOCUMENTS 421765 11/1925 Fed. Rep. of Germany ..... 280/11.1 BT

*Primary Examiner*—John J. Love

*Assistant Examiner*—Richard Lamby

*Attorney, Agent, or Firm*—Browdy and Neimark

[57] ABSTRACT

A device apt to permit skiing practice on snowless ground is described. The device in question makes possible a complete efficient training, being suitable to simulate all possible operating conditions of a ski.

According to a remarkable feature of the device of the invention, it allows to run across curves having any bending radius if it is "driven" by the user acting on the device in the same manner as on a normal ski.

The device comprises two sets of sliding wheels, the wheels of each set being connected by a cross element. Said cross elements are pivoted independently from each other to an essentially central shaped plate forming the means to which the user's foot is secured. Between the plate and cross elements elastic means are interposed whose elongation degree and the resulting angle $\alpha$ formed at rest between said plate and cross element are limited by an adjustable stop means.

7 Claims, 9 Drawing Figures

DEVICE APT TO PERMIT SKIING ON SNOWLESS GROUND

The present invention relates to a device apt to permit skiing practice on snowless ground.

The device in question makes possible a complete efficient training, both for learning skiing techniques and improvements of same. The device is in fact suitable to simulate all possible operating conditions of a ski.

It is known that skis are basically elastically deformable structures, both in relation to the condition and type of snow covered route and in regard to the guiding and control action exerted on the ski by the user to obtain the best performance from it. The device according to this invention is structured so as to behave like a ski true and proper on snowless ground, and which is able to assume all the possible elastic deformations which a real ski would assume in use on snow covered ground.

According to a remarkable feature of the inventive device, it allows to run across curves having any bending radius of it is "driven" by the user acting on the device in the same manner as on a ski, as this will be explained in the following disclosure.

A further characteristic of the device according to the invention is that thanks to the above elastic means the front and rear parts can take, as to the ground, on a different trim with respect to each other. Under this aspect, the device may be adjusted for at least three different trims, as a function of the user's experience.

The characteristics and advantages of the device used for ski practice on snowless ground according to this invention will be evident from the following detailed description of one of its non limitative embodiments, taken in conjunction with the annexed drawings, in which.

Figure 1:
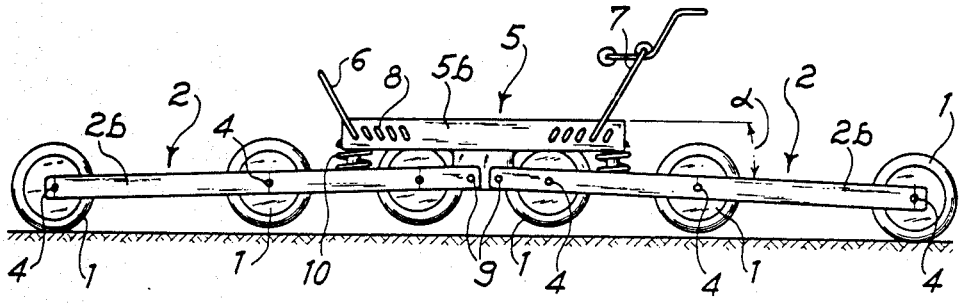
FIG. 1 is a side view of the device shown in rest position, according to a first possible trim adjustment.
Figure 2:
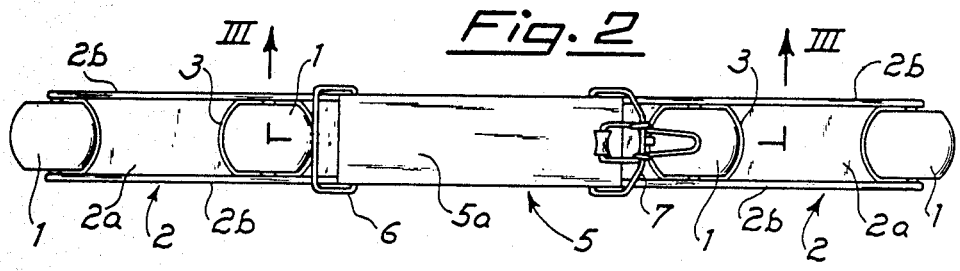
FIG. 2 is a plan view of the device.

Having reference first to FIGS. 1 and 2, the device according to the invention comprises a plurality of wheels 1 which, in the form considered, are six, subdivided in two sets of three wheels which constitute, respectively, the front and rear wheel train. In the figures considered the front train of wheels is shown on the left.

Figure 4:
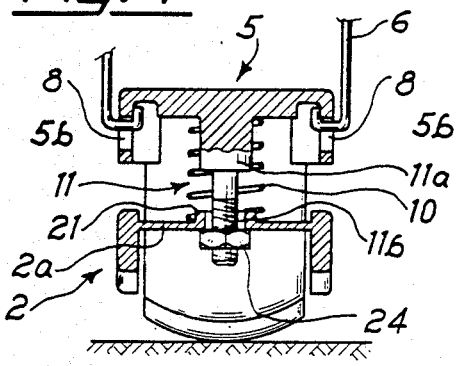
FIG. 4 is a view of the device taken on line IV—IV of FIG. 3.

Wheels 1 of each set are interconnected by a cross element 2, consisting of a rectilinear rod which has, in transversal cross-section, a substantially double T shaped form (see FIG. 4). The central side 2*a* of cross element 2 is provided with apertures 3 inside which wheels 1 are rotatably arranged. These latter wheels, in particular, are sustained by transversal shafts 4 which permit rotation of said wheels 1, for example by the interposition of ball bearings. Shafts 4 are sustained by cross element 2, in particular their ends are inserted in lateral edges 2*b* of cross element 2.

Figure 3:
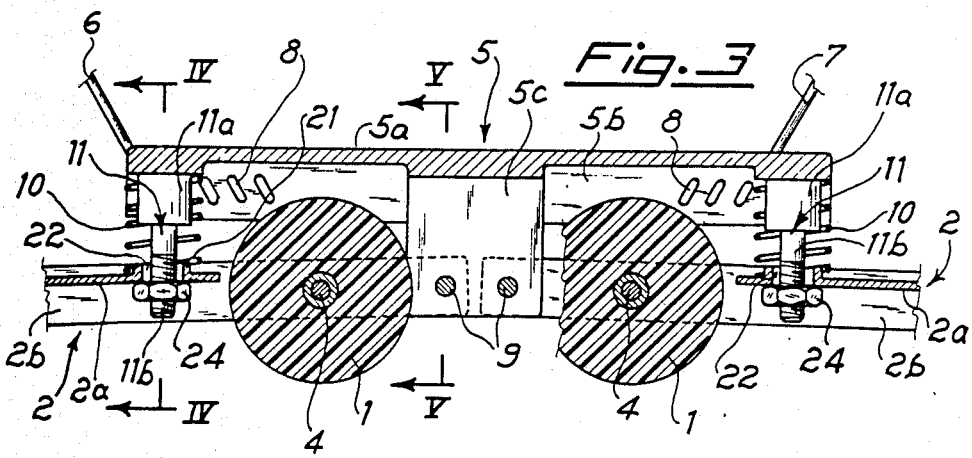
FIG. 3 is a view of the device taken on line III—III of FIG. 2.
Figure 5:
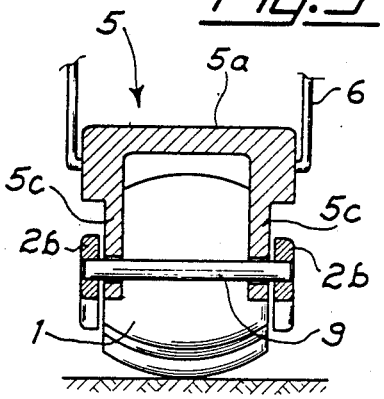
FIG. 5 is a view of the device according to section V—V of FIG. 3.

Having reference now also to FIGS. 3 to 5, the device according to this invention comprises in the center of its top part, a plate 5 preferably made of metal, the top horizontal face 5*a* of which forms the resting base for the user's boot which will be secured to plate 5 by the known type of spring attachement 6, 7. Plate 5 is substantially "U" shaped when viewed in transversal cross-section and its vertical walls 5*b* are provided with elongated apertures 8 to permit adjustment of the position of spring attachment 6, 7 as a function of the size of the wearer's boots.

As shown specifically in FIGS. 1, 3, 4 and 5, plate 5 is provided centrally, on vertical walls 5*b*, with an appendix 5*c*, to which are pivoted, through pins 9, the ends of sides 2*b* of cross elements 2. In this way, the latter and hence wheels 1 that they support may rotate around spindles 9 with respect to plate 5. Said rotations are controlled by the presence of elastic means interposed between plate 5 and cross elements 2. Moreover, adjustable stop means are provided so as to enable varying the rotation allowed to cross elements 2 with respect to plate 5.

The elastic means and the associated stop means are provided on the ends of plate 5 and, since they are equal and located symmetrically, only elastic means and stop means provided at one of the ends of plate 5 will be described. With specific reference to FIGS. 3 and 4, the elastic means provided at the left end of plate 5 are described. Said means comprise a coil spring 10, fitted around a small shaft 11 produced integral with plate 5 and extending downward, mainly in the direction of cross element 2. Shaft 11 has a first top part 11*a* of larger diameter, and a second lower part 11*b* of smaller diameter partially threaded.

As it can be noted, particularly in FIGS. 3 and 4 the lower part of spring 10 engages with the top surface of the end of wall 2*a* of cross element 2 while the upper part of spring 10 engages with the end of the plate 5. In particular, it is maintained in position as said wall 2*a* has an annular projecting part 21 apt to engage with the end of spring 10. At the upper end spring 10 is maintained in position by part 11*a* of shaft 11.

Figure 6:
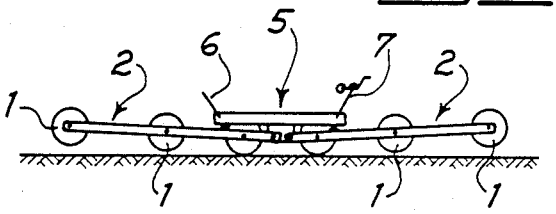
FIG. 6 is a schematic view of the device at rest in a second possible trim adjustment.

The length of part 11*b* of shaft 11 is such that the part, crossing a longitudinal elongated hole 22 of the cross element 2, extends to a point below the latter and on its lower end is threaded so as to receive a nut 24 used to control the trim of the device; in fact, by tightening the nut 24, the front set lifts up (FIG. 7), whilst by tightening both nuts 24 also the rear set will lift up (FIG. 6). The nuts 24 accomplish in practice the above named stop means for cross elements 2 that limit and adjust the angle comprised between the latter and plate 5 by adjusting the elongation degree of elastic means 10. If both nuts 24 are unscrewed so as to reach the end of part 11*b*, the device draws up as shown in FIGS. 1 and 3.

It is opportune to point out that of the three trims in rest position above considered, that of FIG. 1 is intended for experienced users. During use, in fact the device can assume all the possible configurations between that of FIG. 1, curved downwards in which springs 10 are almost totally relaxed and the opposite configuration with the ends sloping upwards (FIG. 6) in which springs 10 are almost totally compressed. Through this possibility there is achieved the remarkable and original technical effect of causing the behaviour of the device to be the same as that of a ski. In fact the expert user will be able to "drive" his own device by giving it a lateral tilting (allowed by the curvature of the contact surface of wheels with the grouns) as he would use a ski, and by simultaneously applying to the plate 5 a pressure of suitably grade value so as to obtain a temporary reduction of angle $\alpha$ comprised between the plane of plate 5 and the cross elements 2 of front and rear wheels 1. The device thus attains what is one of its main purposes, that is to allow to perform turns of any bending radius. At the end of the turn the device will be brought back in configuration near to that of FIG. 1, also through the relaxing action of springs 10 whose extension will be always controlled by the user as well and the opposite configuration with the ends curved upward. It is especially in curves, where the external device is subject to the highest degree of stress, that this will assume the second configuration, while the internal device may maintain the configuration of FIG. 1 or set itself rectilinear with all of wheels 1 in contact with the ground. The rest position trim shown in FIG. 6 is contemplated for beginners, as it facilitates operation in curves. Lastly, the rest position trim shown in FIG. 7 is contemplated for users with average experience.

The advantages of the device according to this invention are evident from the above description of the device.

Figure 7:
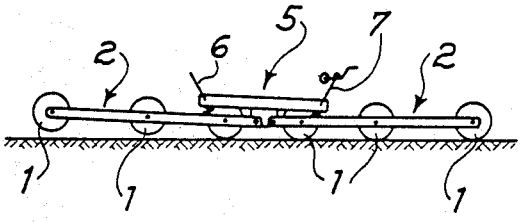
FIG. 7 is a schematic view of the device at rest, in a third possible trim adjustment.

It is evident that the three trims, static or rest, of the device seen in FIGS. 1, 6 and 7 are only possible cases of other intermediate trims afforded by the device according to this invention.

It should also be noted that, as shown particularly in FIGS. 1 and 3, at least one sliding wheel 1 of each front and rear set is set between the hinged points of cross elements 2 of plate 5 and the elastic means above described. This arrangement makes the device according to the invention particularly stable at all times and in any trim assumed.

Figure 9:
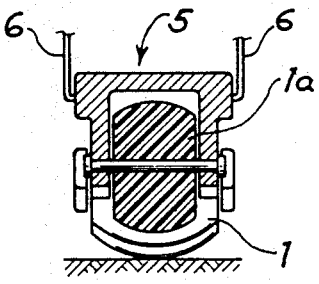
FIG. 9 shows a view of the device of FIG. 8 taken along line IX—IX of the same figure.
Figure 8:
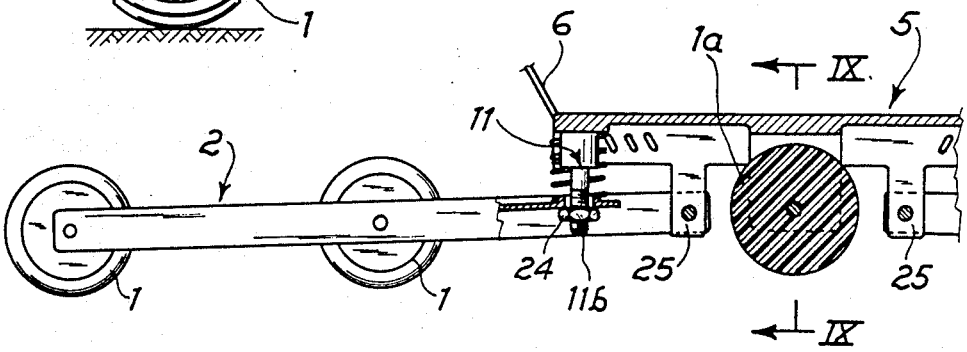
FIG. 8 shows in a partial side view an embodying variation of the device according to the invention.

Referring now to FIGS. 8 and 9 an embodying variation of the device according to the present invention will now be briefly described, which makes recourse to the same inventive idea of the preceding embodiment. In the above named figures the same elements of the previous figures are denoted by the same reference numbers.

According to this variation the cross elements 2 are shorter and the ends thereof are pivoted on little appendixes 25 protruding from the bottom of plate 5. Centrally of the latter on the appendixes 5*c* a sliding small wheel 1*a* is rotatably mounted which, as it is particularly noted in FIG. 9, has lesser width than the remaining small wheels 1.

Elastic means 10 and stop means 24 are still associated with spindle 11. They still engage plate 5 and cross elements 2, but between the pivot point of the latter on plate 5 and the engagement area with spring 10 no sliding wheel is provided.

This embodying variation has the same advantages of the previsous embodiment too.

It is clear, finally, that variants and/or modifications may be introduced in the device according to the invention, without departing from the scope of the invention itself.

I claim:

1. Roller suitable to permit skiing practice on snowless ground comprising a front set and a rear set of sliding wheels, first and second connecting element of the wheels of said front and rear sets, respectively, the wheels being rotatably mounted on said respective first and second connecting elements, a central foot supporting element to which said first and second connecting elements are pivotably connected, first and second elastic means interposed, respectively, between said first and second connecting elements and the central foot supporting element, wherein said first and second connecting elements of the front and rear sets comprise, respectively, first and second essentially elongated rectilinear members on which said wheels of said front and rear set, respectively, are longitudinally mounted, a rearward end of said first connecting element facing a forward end of said second connecting element, the facing ends of said rectilinear members being pivotably connected to appendixes disposed rearward and forward, respectively, of said first and second elastic means, said appendixes extending downwardly from essentially the middle of the central foot supporting element, said front set of sliding wheels including at least one end sliding wheel disposed forward of said first elastic means, said rear set of sliding wheels including at least one end sliding wheel disposed rearward of said second elastic means.

2. Roller according to claim 1, further comprising at least one center sliding wheel of each front and rear set of wheels disposed between the respective pivotable connections of said first and second connecting elements to said respective appendixes of the central foot supporting element and said respective first and second elastic means.

3. Roller according to claim 1, wherein the central foot supporting element is a substantially inverted U-shaped plate having a length smaller than the length of the connecting elements.

4. Roller according to claim 1, wherein between the pivoting point of said first and second connecting elements to said central foot supporting element and the area wherein said respective first and second elastic means are placed, no sliding wheel is provided, at least one sliding wheel being rotatably mounted on said appendixes.

5. Roller according to claim 1, wherein said first and second elastic means each comprise a spring co-axial with a shaft, secured to an end of said central foot supporting element and extending in the direction of said respective connecting element, said spring engaging at one end of said respective central supporting element and at the other end of a transversal wall of said respective connecting element, adjustable stop means of said respective elastic means being placed on said shaft beneath said wall.

6. Roller according to claim 5, wherein said transversal wall of said respective connecting element is provided with a longitudinally elongated hole through which passes a threaded part of said shaft, an adjustment nut being applied to its lower projecting end.

7. Roller according to claim 6, further comprising at least one center sliding wheel of each front and rear set of wheels disposed between the respective pivotable connections of said first and second connecting elements to said respective middle appendixes of the central foot supporting element and said respective first and second elastic means, wherein said nut can be brought, by screwing it on the threaded part of said shaft, from a first to a second position, where, in the first position, said nut is remote from the central foot supporting element thus releasing said spring and causing said spring to be compressible, whereby the set of wheels of said respective connecting element incline upwardly at the center of the roller with the end sliding wheel at rest in contact with the ground and the center sliding wheel uplifted with respect to the roller, and, in the second position, said nut is near to the central foot supporting element, thus rotating said respective connecting element about said respective pivotable connection to said respective appendix from its orientation when said nut is in the first position, to an orientation causing almost total compression and thus deactivation of said spring, and the end set of wheels of said respective connecting element is lifted with respect to the ground and said center wheel or said respective connecting element is in contact with the ground.

* * * * *